US006267106B1

(12) United States Patent
Feucht

(10) Patent No.: US 6,267,106 B1
(45) Date of Patent: Jul. 31, 2001

(54) INDUCTION VENTURI FOR AN EXHAUST GAS RECIRCULATION SYSTEM IN AN INTERNAL COMBUSTION ENGINE

(75) Inventor: Dennis D. Feucht, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/437,023

(22) Filed: Nov. 9, 1999

(51) Int. Cl.[7] ..... F02M 25/07
(52) U.S. Cl. ..... 123/568.17
(58) Field of Search ..... 123/568.17; 60/605.2

(56) References Cited

U.S. PATENT DOCUMENTS

| | | | | |
|---|---|---|---|---|
| 2,354,179 | * | 7/1944 | Blanc | 123/568.17 |
| 3,662,722 | * | 5/1972 | Sarto | 123/568.17 |
| 3,680,534 | * | 8/1972 | Chavant | 123/568.17 |
| 4,426,848 | | 1/1984 | Stachowicz . | |
| 4,756,285 | * | 7/1988 | Pischinger | 123/568.17 |
| 5,333,456 | | 8/1994 | Bollinger . | |
| 5,611,203 | | 3/1997 | Henderson et al. . | |
| 5,611,204 | | 3/1997 | Radovanovic et al. . | |
| 5,617,726 | | 4/1997 | Sheridan et al. . | |

FOREIGN PATENT DOCUMENTS

| | | |
|---|---|---|
| 0 857 870 | 8/1998 | (EP) . |
| 713331 | 8/1954 | (GB) . |
| 2 284 016 | 5/1995 | (GB) . |
| 8326609 | 12/1996 | (JP) . |

* cited by examiner

*Primary Examiner*—Erick Solis
(74) *Attorney, Agent, or Firm*—Todd T. Taylor

(57) ABSTRACT

An internal combustion engine includes a combustion air supply; an exhaust manifold; and an induction venturi. The induction venturi includes a combustion air inlet connected and in communication with the combustion air supply, an exhaust gas inlet connected and in communication with the exhaust manifold, and an outlet. A venturi section terminates at a venturi throat and is in communication with the combustion air inlet. An expansion section is positioned between and in communication with the venturi section and the outlet. At least one induction port terminates adjacent the venturi throat and within the expansion section.

23 Claims, 2 Drawing Sheets

INDUCTION VENTURI FOR AN EXHAUST GAS RECIRCULATION SYSTEM IN AN INTERNAL COMBUSTION ENGINE

TECHNICAL FIELD

The present invention relates to exhaust gas recirculation systems in an internal combustion engine, and, more particularly, to induction venturi in exhaust gas recirculation systems.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NoX). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably reintroduced to the intake air stream downstream of the compressor and air-to-air after cooler (ATAAC). Reintroducing the exhaust gas downstream of the compressor and ATAAC is preferred due to the reliability and maintainability concerns that arise if the exhaust gas passes through the compressor and ATAAC. An example of such an EGR system is disclosed in U.S. Pat. No. 5,802,846 (Bailey), which is assigned to the assignee of the present invention.

With conventional EGR systems as described above, the charged and cooled combustion air which is transported from the ATAAC is at a relatively high pressure as a result of the charging from the turbocharger. Since the exhaust gas is also typically inducted into the combustion air flow downstream of the ATAAC, conventional EGR systems are configured to allow the lower pressure exhaust gas to mix with the higher pressure combustion air. Such EGR systems may include a venturi section which induces the flow of exhaust gas into the flow of combustion air passing therethrough. An efficient venturi section is designed to "pump" exhaust gas from a lower pressure exhaust manifold to a higher pressure intake manifold. However, because varying EGR rates are required throughout the engine speed and load range, a variable orifice venturi may be preferred. Such a variable orifice venturi is physically difficult and complex to design and manufacture. Accordingly, venturi systems including a fixed orifice venturi and a combustion air bypass circuit are conventionally favored. The bypass circuit consists of piping and a butterfly valve in a combustion air flow path which is parallel with the venturi flow path. The butterfly valve is controllably actuated using an electronic controller which senses various parameters associated with operation of the engine.

With a venturi section as described above, the maximum flow velocity and minimum pressure of the combustion air flowing through the venturi section occurs within the venturi throat disposed upstream from the expansion section. The butterfly valve is used to control the flow of combustion air to the venturi throat, which in turn affects the flow velocity and vacuum pressure created therein. By varying the vacuum pressure, the amount of exhaust gas which is induced into the venturi throat of the venturi section can be varied. However, inducing the exhaust gas into the flow of combustion air in the venturi throat may affect the diffusion and pressure recovery of the mixture within the expansion section of the venturi.

The present invention is directed to overcoming one or more of the problems as set forth above.

DISCLOSURE OF THE INVENTION

In one aspect of the invention, an internal combustion engine comprises a combustion air supply; an exhaust manifold; and an induction venturi. The induction venturi includes a combustion air inlet connected and in communication with the combustion air supply, an exhaust gas inlet connected and in communication with the exhaust manifold, and an outlet. A venturi section terminates at a venturi throat and is in communication with the combustion air inlet. An expansion section is positioned between and in communication with the venturi section and the outlet. At least one induction port terminates adjacent the venturi throat and within the expansion section.

In another aspect of the invention, an induction venturi induces an exhaust gas into a flow of combustion air in an exhaust gas recirculation system of an internal combustion engine. The internal combustion engine includes a combustion air supply and an exhaust manifold. The induction venturi comprises a housing having a combustion air inlet for receiving combustion air from the combustion air supply, an exhaust gas inlet for receiving exhaust gas from the exhaust manifold, an outlet, and an inner chamber in communication with each of the combustion air inlet, the exhaust gas inlet and the outlet. A venturi section terminates at a venturi throat and is in communication with the combustion air inlet. The venturi section is positioned within the inner chamber of the housing. An expansion section is positioned between and in communication with the venturi section and the outlet. At least one induction port is defined by the housing and/or venturi section. At least one induction port terminates adjacent the venturi throat and within the expansion section.

In yet another aspect of the invention, a method of operating an internal combustion engine having an exhaust gas recirculation system comprises the steps of: providing a combustion air supply; providing an exhaust manifold; providing an induction venturi including a combustion air inlet connected and in communication with the combustion air supply, an exhaust gas inlet connected and in communication with the exhaust manifold, an outlet, a venturi section terminating at a venturi throat and in communication with the combustion air inlet, an expansion section positioned between and in communication with the venturi section and the outlet, and at least one induction port terminating adjacent the venturi throat and within the expansion section; transporting combustion air from the combustion air supply, through the combustion air inlet and through the venturi section; and transporting exhaust gas from the exhaust gas manifold, through at least one induction port and into the expansion chamber.

BEST MODE FOR CARRYING OUT THE INVENTION

Figure 1:
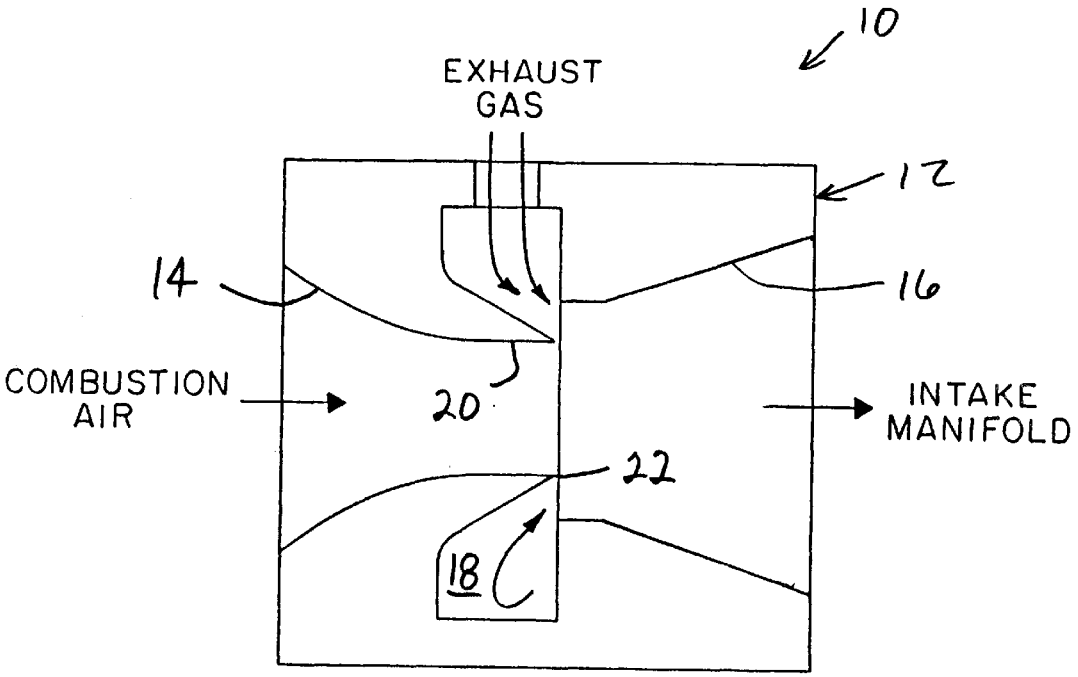
FIG. 1 is a schematic, sectional view illustrating an embodiment of an induction venturi of the present invention for use in an exhaust gas recirculation system of an internal combustion engine.

Referring now to the drawings, and more particularly to FIG. 1, there is shown a schematic representation of an induction venturi 10 of the present invention which may be utilized with an EGR system in an internal combustion engine. Induction venturi 10 includes a housing 12 defining a venturi section 14, expansion section 16 and inner chamber 18. Venturi section 14 receives combustion air from a combustion air supply such as a turbocharger and aftercooler associated with the internal combustion engine. Venturi section 14 has a generally nozzle shape and terminates at a venturi throat 20 at which point the combustion air travels at maximum velocity and minimum pressure adjacent exit end 22. Expansion section 16 is disposed immediately adjacent to and downstream from venturi section 14, relative to the direction of flow through venturi section 14. Inner chamber 18 receives exhaust gas from an exhaust manifold of the internal combustion engine. Inner chamber 18 is positioned generally radially outward from and annularly around venturi throat 20 and exit end 22. The exhaust gas flows in the annular space defined by inner chamber 18 and flows through an annular-shaped induction port defined between expansion section 16 and exit end 22. The exhaust gas thus mixes with the combustion air adjacent to exit end 22 and within expansion section 16.

Conventionally, an induction venturi includes a venturi section through which the combustion air flows at maximum velocity and minimum pressure. Since the minimum pressure of the combustion air occurs within the venturi throat of the venturi section, conventional wisdom is for the induction port which induces exhaust gas into the flow of combustion air to also terminate within the venturi throat so that the exhaust gas can be effectively drawn into the flow of combustion air as a result of the vacuum pressure created therein. However, the inventor of the present invention has surprisingly found that an induction port which terminates immediately downstream and adjacent to exit end 22 of venturi section 14 and within expansion section 16 still results in adequate exhaust gas being drawn into the flow of combustion air flowing through induction venturi 10. Additionally, diffusion of the exhaust gas into the combustion air has been found to be improved, and pressure recovery within expansion section 16 has also been found to be improved.

Figure 3:
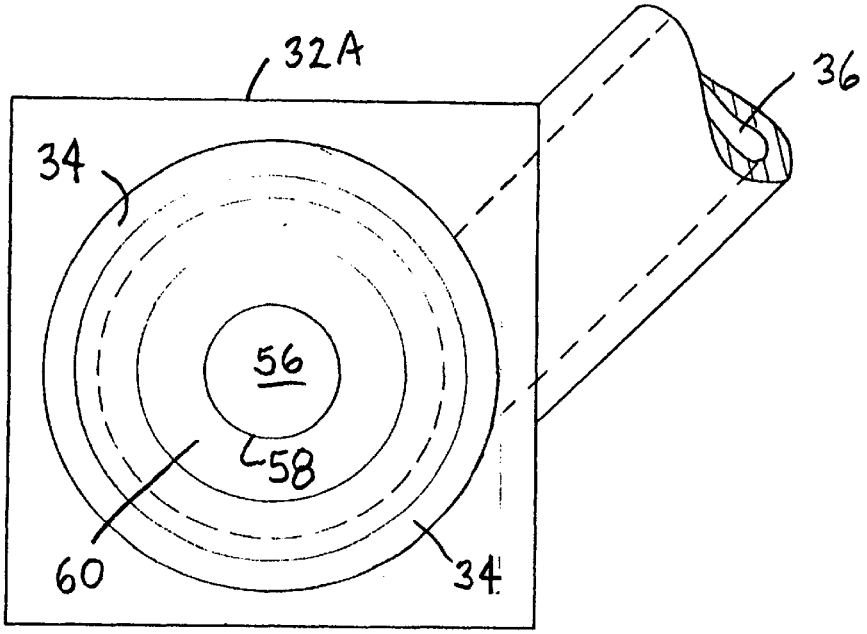
FIG. 3 is an end, sectional view taken along line 3—3 in FIG. 2.
Figure 2:
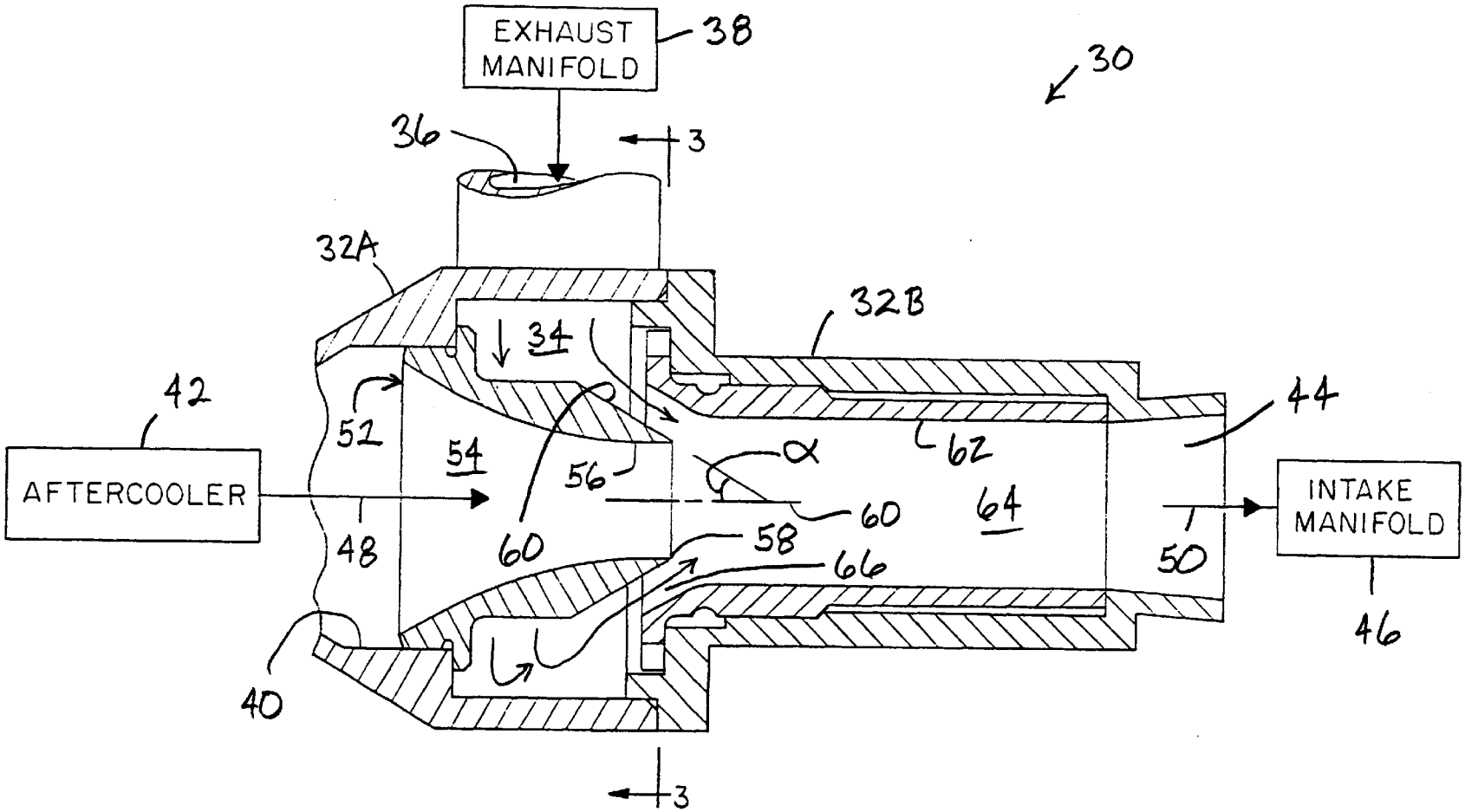
FIG. 2 is a side, sectional view of an embodiment of an induction venturi of the present invention.

FIGS. 2 and 3 illustrate an embodiment of an induction venturi 30 of the present invention. Induction venturi 30 includes a two part housing 32A, 32B. Housing part 32A defines inner chamber 34 which is connected with an exhaust gas inlet 36, which in turn receives exhaust gas from an exhaust manifold 38 of an internal combustion engine. Housing part 32A also includes a combustion air inlet 40 which receives combustion air from a combustion air supply such as a turbocharger (not shown) and an aftercooler 42.

Housing part 32B is connected with housing part 32A and includes an outlet 44 which is fluidly connected with an intake manifold 46 of the internal combustion engine. Housing part 32B is disposed downstream from housing part 32A, relative to a direction of flow through induction venturi 30 from combustion air inlet 40 to outlet 44, indicated by arrows 48 and 50.

Venturi section 52 is a generally cone-shaped piece which is positioned within inner chamber 34 and carried by housing part 32A. Venturi section 52 has a venturi nozzle 54 which terminates at a venturi throat 56. The combustion air flowing through venturi nozzle 54 from aftercooler 42 is at a maximum velocity and minimum pressure when flowing through venturi throat 56 adjacent exit end 58. Venturi section 52 has an outer surface 60 which extends from exit end 58 and is disposed at an acute angle of approximately 30° relative to longitudinal axis 60 of venturi section 52.

Housing part 32B is attached with and carries a liner 62. Liner 62 defines an expansion section 64 disposed downstream from venturi section 52. Combustion air which flows through exit end 58 into expansion section 64 diffuses or expands therein and thus increases in pressure within expansion section 64. Expansion section 64 within liner 62 has a generally circular cross-sectional shape when viewed from the right side of FIG. 2. Additionally, venturi throat 56 and exit end 58 also have a generally circular cross-sectional shape, as shown in FIG. 3. Thus, an induction port 66 is defined in the annular space between exit end 58 and liner 62. Induction port 66 and inner chamber 34 have a substantially annular shape when viewed in cross-section as shown in FIG. 3. The particular shape of inner chamber 34 can vary dependent upon the specific application of induction venturi 30.

To assemble induction venturi 30, venturi section 52 is installed within housing part 32A and liner 62 is installed within housing part 32B. Housing parts 32A and 32B are then attached together as shown. By providing a venturi section 52 and liner 62 that are removably installed within housing parts 32A and 32B, respectively, it is possible to change the configuration of induction venturi 30, depending upon the specific engine operating characteristics with which induction venturi 30 is utilized. For example, the configuration of venturi nozzle 54 and venturi throat 56 within venturi section 52 may be changed, or the approach angle of outer surface 60 may be changed. Moreover, the diameter, curvature, expansion rate, etc. within expansion section 64 may be changed by using a differently configured liner 62. It naturally follows that in high volume production of a given configuration, the inner venturi nozzle 54 will be cast integral with the housing 32A and the expansion section 64 will be cast integral with the housing 32B.

INDUSTRIAL APPLICABILITY

During use, cooled and compressed combustion air flows into induction venturi 30 at combustion air inlet 40. Additionally, exhaust gas flows from exhaust manifold 38 to exhaust gas inlet 36 and into inner chamber 34 surrounding venturi section 52. The combustion air flows through venturi section 52 and is at a maximum velocity and minimum pressure adjacent exit end 58 of venturi throat 56. The exhaust gas flowing within inner chamber 34 is at a higher pressure than the combustion air exiting from exit end 58 and thus is drawn through the annular shaped induction port 66 surrounding exit end 58. The exhaust gas impinges with the combustion air at an angle of approximately 30°. The combustion air and exhaust gas mix, diffuse and expand within expansion section 64 and flow from the expanding outlet 44 to intake manifold 46.

Induction venturi 30 of the present invention provides effective induction of the exhaust gas into the flow of combustion air, while at the same time improving diffusion and pressure recovery within expansion section 64 and 44. By configuring venturi section 52 and expansion section 64 as parts which are separate from housing 32A, 32B and removably installed within housing 32A, 32B, the geometric configuration of induction venturi 30 and flow characteristics of combustion air and exhaust gas flowing therethrough may be changed dependent upon the specific operating characteristics of the internal combustion engine.

Other aspects, objects and advantages of this invention can be obtained from a study of the drawings, the disclosure and the appended claims.

What is claimed is:

1. An internal combustion engine, comprising:

a combustion air supply;

an exhaust manifold; and an induction venturi including a combustion air inlet connected and in communication with said combustion air supply, an exhaust gas inlet connected and in communication with said exhaust manifold, an outlet, a venturi section terminating at a venturi throat exit end and in communication with said combustion air inlet, an expansion section positioned between and in communication with said venturi section exit end and said outlet, and at least one induction port terminating separate from and adjacent said venturi throat exit end within said expansion section.

2. The internal combustion engine of claim 1, further comprising a housing with an inner chamber, said venturi section positioned within said inner chamber.

3. The internal combustion engine of claim 2, wherein said venturi section has a generally cone shape, said inner chamber surrounding said venturi section and being in communication with said expansion section.

4. The internal combustion engine of claim 3, wherein said venturi section terminates at an exit end adjacent said venturi throat, each of said exit end and said expansion section having a generally circular cross section, said at least one induction port comprising an annular space between said exit end and said expansion section.

5. The internal combustion engine of claim 4, wherein said at least one induction port comprises an annular space which is positioned radially around said exit end.

6. The internal combustion engine of claim 4, wherein said venturi section has an outer surface extending from said exit end which is disposed at an angle of approximately 30° relative to a longitudinal axis of said venturi section.

7. The internal combustion engine of claim 4, further comprising a liner disposed within said housing and defining said expansion section.

8. The internal combustion engine of claim 2, wherein said venturi section is separate from and carried by said housing.

9. The internal combustion engine of claim 1, wherein said combustion air supply includes an air-to-air aftercooler.

10. An induction venturi for inducing exhaust gas into a flow of combustion air in an exhaust gas recirculation system of an internal combustion engine, the internal combustion engine including a combustion air supply and an exhaust manifold, said induction venturi comprising:

a housing having a combustion air inlet for receiving combustion air from the combustion air supply, an exhaust gas inlet for receiving exhaust gas from the exhaust manifold, an outlet, and an inner chamber in communication with each of said combustion air inlet, said exhaust gas inlet and said outlet;

a venturi section terminating at a venturi throat exit end and in communication with said combustion air inlet, said venturi section positioned within said inner chamber;

an expansion section positioned between and in communication with said venturi section exit end and said outlet; and at least one induction port defined by at least one of said housing and said venturi section, said at least one induction port terminating separate from and adjacent said venturi throat exit end within said expansion section radially outwardly of said venturi throat.

11. The induction venturi of claim 10, wherein said at least one induction port comprises a single induction port which is defined by each of said housing and said venturi throat.

12. The induction venturi of claim 10, wherein said venturi section has a generally cone shape, said inner chamber surrounding said venturi section and being in communication with said expansion section.

13. The induction venturi of claim 12, wherein said venturi section terminates at an exit end adjacent said venturi throat, each of said exit end and said expansion section having a generally circular cross section, said at least one induction port comprising an annular space between said exit end and said expansion section.

14. The induction venturi of claim 13, wherein said at least one induction port comprises an annular space which is positioned radially around said exit end.

15. The induction venturi of claim 13, wherein said venturi section has an outer surface extending from said exit end which is disposed at an angle of approximately 30° relative to a longitudinal axis of said venturi section.

16. The induction venturi of claim 13, further comprising a liner disposed within said housing and defining said expansion section.

17. The induction venturi of claim 12, wherein said venturi section is separate from and carried by said housing.

18. The induction venturi of claim 10, wherein said combustion air supply includes an air-to-air aftercooler.

19. A method of operating an internal combustion engine having an exhaust gas recirculation system, comprising the steps of:

providing a combustion air supply;

providing an exhaust manifold;

providing an induction venturi including a combustion air inlet connected and in communication with said combustion air supply, an exhaust gas inlet connected and in communication with said exhaust manifold, an outlet, a venturi section terminating at a venturi throat and in communication with said combustion air inlet, an expansion section positioned between and in communication with said venturi section and said outlet, and at least one induction port terminating adjacent said venturi throat and within said expansion section;

transporting combustion air from said combustion air supply, through said combustion air inlet and through said venturi section into said expansion section; and transporting exhaust gas from said exhaust gas manifold, through said at least one induction port and into said expansion section separately from the combustion air.

20. The method of claim 19, wherein said induction venturi includes a housing with an inner chamber, and said venturi section is positioned within said housing and has a generally cone shape, said inner chamber surrounding said venturi section and being in communication with said expansion section.

21. The method of claim 20, wherein said venturi section terminates at an exit end adjacent said venturi throat, each of said exit end and said expansion section having a generally circular cross section, said at least one induction port comprising an annular space between said exit end and said expansion section.

22. The method of claim 21, wherein said at least one induction port comprises an annular space which is positioned radially around said exit end.

23. The induction venturi of claim 21, wherein said venturi section has an outer surface extending from said exit end which is disposed at an angle of approximately 30° relative to a longitudinal axis of said venturi section.

* * * * *